United States Patent [19]

van der Hoeven et al.

[11] Patent Number: 4,950,424

[45] Date of Patent: Aug. 21, 1990

[54] NON-AQUEOUS LIQUID DETERGENT COMPOSITIONS CONTAINING DI-SULPHONIC ACIDS AS DEFLOCCULANTS

[75] Inventors: Philippus C. van der Hoeven, Prinsenbeek; Nicolaas C. Laane, Rotterdam; Peter Versluis, Vlaardingen; Adrianus Visser, Maassluis, all of Netherlands

[73] Assignee: Lever Brothers Company, New York, N.Y.

[21] Appl. No.: 337,581

[22] Filed: Apr. 13, 1989

[30] Foreign Application Priority Data

Apr. 29, 1988 [GB] United Kingdom ..... 8810191

[51] Int. Cl.[5] ..... C11D 1/22; C11D 1/83; C11D 3/12

[52] U.S. Cl. ..... 252/540; 252/530; 252/539; 252/549; 252/558; 252/559; 252/DIG. 1; 252/DIG. 14

[58] Field of Search ..... 252/559, 540, 174.21

[56] References Cited

U.S. PATENT DOCUMENTS

| | | | |
|---|---|---|---|
| 2,081,876 | 5/1937 | Prahe | 260/150 |
| 2,249,757 | 7/1941 | Flett | 260/512 |
| 2,787,639 | 4/1957 | Sargent | 260/513 |
| 3,663,609 | 5/1972 | Woo I | 260/512 R |
| 3,812,044 | 5/1974 | Connor et al. | 252/89 |
| 3,816,353 | 6/1974 | Sharman et al. | 252/558 |
| 3,864,286 | 2/1975 | Anderson | 252/559 |
| 3,975,312 | 8/1976 | Davies et al. | 252/535 |
| 4,088,680 | 5/1978 | Woo II | 260/512 R |
| 4,264,446 | 4/1981 | Carleton et al. | 252/99 |
| 4,316,812 | 2/1982 | Hancock et al. | 252/99 |
| 4,581,042 | 4/1986 | Willmore | 51/293 |

FOREIGN PATENT DOCUMENTS

| | | |
|---|---|---|
| 266199 | 5/1988 | European Pat. Off. . |
| 2195649 | 4/1988 | United Kingdom . |

OTHER PUBLICATIONS

*McCutcheon's Emulsifiers & Detergents,* 1983 *North American Edition,* McCutcheon Division, MC Publishing Co., Glen Rock, N.J., p. 122.

*Primary Examiner*—Paul Liederman
*Assistant Examiner*—A. Beadles-Hay
*Attorney, Agent, or Firm*—Ronald A. Koatz

[57] ABSTRACT

A substantially non-aqueous liquid cleaning product comprising solid particles dispersed in a liquid solvent phase and a deflocculant which comprises a di-sulphonic acid or a salt thereof.

8 Claims, No Drawings

NON-AQUEOUS LIQUID DETERGENT COMPOSITIONS CONTAINING DI-SULPHONIC ACIDS AS DEFLOCCULANTS

The present invention comprises substantially non-aqueous liquid cleaning products of the kind comprising solid particles dispersed in a liquid phase.

In European Patent Specification EP No. 266199-A (Unilever) there is described use of substances, termed therein 'deflocculants' for stabilising non-aqueous products of the kind referred to above. These substances appeared to manifest their action by lowering viscosity and/or by inhibiting solidification (setting) of the product. One particularly preferred deflocculant described there was the free acid form of dodecyl benzene sulphonic acid (ABSA).

The applicants have now found that generally comparable, or even superior, viscosity reduction and/or prevention of setting, may be achieved by using a deflocculant which comprises a di-sulphonic acid or an acid salt thereof. The compositions may optionally contain combinations of such di-sulphonic acids and acid salts.

Thus, according to the invention, there is provided a substantially non-aqueous liquid cleaning product comprising solid particles dispersed in a liquid phase and a deflocculant which comprises a di-sulphonic acid or an acid salt thereof.

By di-sulphonic acid is meant a molecule having two sulphonic acid (—$SO_3H$) groups. The salts may be partial (mono) salts, i.e. with one sulphonic acid group associated with an organic or inorganic cation, especially an alkali metal ion, most preferably sodium or potassium.

The free acid (as opposed to the acid salt forms) of these di-sulphonic acid deflocculants are most preferred. In this context 'free acid' refers to the substance as it is incorporated into the liquid during manufacture. It should be realised that in some cases, where the dispersed solid particles comprise a high proportion of alkaline inorganic salts, analysis of the ensuing product may only reveal a corresponding salt. That may be due, for example, to the fact that such analytical methods often involve dissolving the product in water, whereupon the alkaline salts and di-sulphonic acid can react to form salts of the acid. In some systems, particularly those containing high proportions of nonionic surfactant, and optionally, trace impurities of water, it may also be possible for some of the di-sulphonic acid to react with the alkaline salts at the particle surfaces in situ.

In these di-sulphonic acids, it is preferred that at least one, most preferably both, of the sulphonic acid groups exist as a benzene sulphonic acid group. It is also preferred that, one or both, as appropriate, of these benzene rings is substituted by an alkyl group.

One preferred class of the di-sulphonic acid deflocculants comprises the di-acids of formula (I) and their salts. In formula (I):

$$R^1—Ph^1—X—Ph^2—R^2 \quad (I)$$

$R^1$ and $R^2$ are independently selected linear or branched $C_{2-20}$ alkyl or $C_{2-20}$ alkenyl groups, $Ph_1$ and $Ph_2$ are phenyl linkages each substituted by a sulphonic acid group, and each optionally independently substituted by one minor substituent, and X represents an oxa (—O—), thia (—S—), amine (—NH—) or methylene (—$CH_2$—) linkage.

Preferably, $R^1$ and $R^2$ are independently selected $C_{6-16}$ alkyl groups and most preferably, one or both represents a decyl ($C_{10}$ alkyl) group. Usually $R^1$ and $R^2$ are the same.

The groups $Ph^1$ and $Ph^2$ are optionally independently substituted by one or more minor substituents such as halo (e.g. chloro), $C_{1-4}$ alkyl, $C_{1-4}$ alkoxy, hydroxy, amino etc. However in many cases they will be unsubstituted except for the sulphonic acid group.

Especially preferred are the di-acids of formula (I) wherein X represents oxa (—O—) and their salts.

The di-sulphonic acids and their acid salts for use in the present invention, especially as defined by formula (I) are either commercially available materials or may readily be prepared by those skilled in the art of organic chemistry.

An alternative class of the di-sulphonic acid deflocculants comprises $C_{2-20}$ linear or branched, alkyl or alkenyl benzene disulphonic acids.

The use of disulphonic acid salts in detergent compositions is not unknown. Thus, U.S. Pat. No. 4,581,042 (Willmore) describes an aqueous composition for removing hard-water build-up from surfaces in which dodecyldiphenyl ether disulphonic acid in sodium salt form (Dowfax 2A1) is used as an emulsion stabiliser. U.S. Pat. No. 4,088,680 (Woo) discloses certain linear alkyl hydrocarbyl oxybenzene disulphonates as suitable surfactants for use in the absence of phosphates. It is stated that such surfactants can be used in liquid heavy duty formulations because of their substantial solubility in water. GB No. 1217137 (Henkel) discloses surfactant mixtures one component of which is a salt of an aliphatic disulphonic acid, the mixture being stated to be biologically easily decomposable. The mixture may be used in aqueous liquid washing compositions.

Liquid cleaning products according to the present invention are non-aqueous dispersions comprising a non-aqueous liquid phase which can be a liquid surfactant, an organic non-aqueous non-surfactant liquid, or a mixture of such materials. Many do contain a surfactant as a dispersed or dissolved solid, or more often, as all or part of said liquid phase. These surfactant compositions are liquid detergent products, e.g. for fabrics washing or hard surface cleaning. However, the wider term 'liquid cleaning product' also includes non-surfactant liquids which are still useful in cleaning, for example non-aqueous bleach products or those in which the liquid phase consists of one or more light, non-surfactant solvents for greasy stain pre-treatment of fabrics prior to washing. Such pre-treatment products can contain solid bleaches, dispersed enzymes and the like.

As well as the liquid phase, such non-aqueous dispersions also contain dispersed particulate solids. These are small (e.g. 10 microns) particles of solid material which are useful in cleaning and could be solid surfactants, builders, bleaches, enzymes or any other such solids known to those skilled in the art.

The particles can be maintained in dispersion (i.e. resist settling, even if not perfectly) by a number of means. For example, settling may be inhibited purely by virtue of the relative small size of the particles and the relatively high viscosity of the solvent phase. In other words, the particles settle very slowly at a rate predicted by Stokes' law or due to formation of a loosely aggregated network of particle flocs. This effect is utilised in the compositions described in patent specifications EP-A-30 096 (ICI) and GB No. 2 158 838A (Colgate). However, there have been several proposals to utilise additional means to enhance solid-suspending properties in such non-aqueous liquids. These are somewhat analogous to so-called external structuring techniques used in aqueous systems; i.e., in addition to the particulate solids and the liquid solvent phase in which they are to be suspended, an additional dispersant is used which by one means or another, acts to aid stable dispersion or suspension of the solids for a finite period.

Whether or not a given disulphonic acid will constitute a preferred deflocculant will depend in part on the nature of the liquid and solid phases. The aforementioned EP No. 266199 describes how a preferred combination of liquid phase, solid phase and deflocculant can be identified by characterising three forms of deflocculated system. A similar approach can be applied to the present invention.

Thus, the first form entails systems in which the size of particles is small enough and the liquid phase viscous enough that the particles settle very slowly and no more phase separation is observed than 1% by volume in 1 week, preferably in 1 month, preferably 3 months. Such products are most suited where low volume fractions of solids are required, yet only minimal visible phase separation is tolerable over the period from manufacture, through storage, until use.

The second form is where low volume fractions of solids are required but visible phase separation can be tolerated. Here the particle size/liquid viscosity combination results in rapid settling, in particular a phase separation of more than 1% by volume in one week. However, the product can be made substantially homogeneous, e.g. by stirring or shaking just prior to use.

In both of the above-mentioned product forms, the disulphonic acid confers the advantage of inhibiting setting of the bulk of the liquid by network formation or the formation of a compacted settled solids layer which is not readily re-dispersible in the liquid phase. Whatever the rate of sedimentation of solids in either product form, this rate is minimised by the deflocculation effect preventing individual particles from agglomerating into larger flocs which then settle more rapidly.

The third product form corresponds to the composition of the final settled layer which will develop eventually if liquids of either of the first two product forms are left to stand. The minimum volume which this layer assumes will be approached asymptotically with progression of time. However, for all practical purposes, after standing a sample of either of the first two product forms for sufficient time, the volume of the settled layer will not substantially decrease further. The composition of that layer can then be analysed by means which will be known to those skilled in the art and this substantially constitutes the composition of the third product form.

A product in the latter category can be formulated by dispersing all major solids in excess liquid and with an amount of disulphonic acid which can be optimised by a means which will be described hereinbelow. Thus, this dispersion can be left to assume the final settled volume, the composition of which is then analysed. In a new composition made-up according to this latter formulation, all minor ingredients can be dissolved and/or dispersed and the sample stored to determine compatibility of the components, optionally followed by minor adjustments in amounts and types of solids, liquids and disulphonic acid to achieve the required balance of rheology, performance and manufacturing cost.

EP No. 266199-A also sets-out a method by which combinations of solids, solvent and deflocculant in which deflocculation occurs can be identified and this can also be applied to the present invention. First, one chooses the liquid and solids according to the intended product form and action. The solids are preferably selected in the form of a powder with a very small particle size, say less than 10 microns. If not already available in such fine form, the solids can be taken in coarser form and ground by appropriate means, such as in a suitable ball mill. The solids are then added progressively (with stirring) to the liquid until sufficient are added, that a substantial viscosity rise is apparent (i.e. the mixture thickens visibly). A sample potential disulphonic acid is then added progressively until deflocculation is detected. If it is not observed at any level of disulphonic acid that material is unsuitable in that particular solids/liquids system and another should be tried.

In its most marked degree, deflocculation is apparent by a readily discernable thinning (viscosity reduction) at some point during addition of structurant whilst stirring. However, the main means of quantitative detection of deflocculation is identification of a viscosity reduction at low shear rates (e.g. at or around 5 $s^{-1}$) as measured in a suitable rheometer. Preferably, at at least some structurant level, at such a shear rate, a viscosity reduction of 25% should be observed, although 50% reduction or even of a whole order of magnitude is even more indicative of a structurant with good deflocculant properties. Although the deflocculants reduce the viscosity of the system, many products according to the invention are still quite viscous at low shear rates (e.g. $>1$ Pas) but they are very shear thinning and so are relatively pourable.

Once a suitable disulphonic acid deflocculant has been identified (for use in a composition according to any aspect of the invention), the optimum amount can be determined by varying the amount of disulphonic acid added to the pre-selected solids/liquid combination and measuring the sedimentation rate at each value. Sedimentation rate can be measured by standing the liquid in a measuring cylinder or other suitable vessel and determining the rate of sinking of the upper surface of the settled layer.

Having selected a viable solids/liquid/disulphonic acid combination, an appropriate final product can then be formulated.

All compositions according to the present invention are liquid cleaning products. They may be formulated in a very wide range of specific forms, according to the intended use. They may be formulated as cleaners for hard surfaces (with or without abrasive) or as agents for warewashing (cleaning of dishes, cutlery etc) either by hand or mechanical means, as well as in the form of specialised cleaning products, such as for surgical apparatus or artificial dentures. They may also be formulated as agents for washing and/or conditioning of fabrics.

In the case of hard-surface cleaning, the compositions may be formulated as main cleaning agents, or pre-treatment products to be sprayed or wiped on prior to removal, e.g. by wiping off or as part of a main cleaning operation.

In the case of warewashing, the compositions may also be the main cleaning agent or a pre-treatment product, e.g applied by spray or used for soaking utensils in an aqueous solution and/or suspension thereof.

Those products which are formulated for the cleaning and/or conditioning of fabrics constitute an especially preferred form of the present invention because in that role, there is a very great need to be able to incorporate substantial amounts of various kinds of solids. These compositions may for example, be of the kind used for pre-treatment of fabrics (e.g. for spot stain removal) with the composition neat or diluted, before they are rinsed and/or subjected to a main wash. The compositions may also be formulated as main wash products, being dissolved and/or dispersed in the water with which the fabrics are contacted. In that case, the composition may be the sole cleaning agent or an adjunct to another wash product. Within the context of the present invention, the term 'cleaning product' also embraces compositions of the kind used as fabric conditioners (including fabric softeners) which are only added in the rinse water (sometimes referred to as 'rinse conditioners').

Thus, the compositions will contain at least one agent which promotes the cleaning and/or conditioning of the article(s) in question, selected according to the intended application. Usually, this agent will be selected from surfactants, enzymes, bleaches, microbiocides, (for fabrics) fabric softening agents and (in the case of hard surface cleaning) abrasives. Of course in many cases, more than one of these agents will be present, as well as other ingredients commonly used in the relevant product form.

The compositions will be substantially free from agents which are detrimental to the article(s) to be treated. For example, they will be substantially free from pigments or dyes, although of course they may contain small amounts of those dyes (colourants) of the kind often used to impart a pleasing colour to liquid cleaning products, as well as fluorescers, bluing agents and the like.

All ingredients before incorporation will either be liquid, in which case, in the composition they will constitute all or part of the liquid phase, or they will be solids, in which case, in the composition they will either be dispersed as deflocculated particles in the solvent or they will be dissolved in the liquid phase. Thus as used herein, the term solids is to be construed as referring to materials in the solid phase which are added to the composition and are dispersed therein in solid form, those solids which dissolve in the liquid phase and those in the liquid phase which solidify (undergo a phase change) in the composition, wherein they are then dispersed.

Some liquids are alone, unlikely to be ideal for combination with specific solids and dispersant/deflocculant. However, they may be able to be incorporated if used with another liquid which does have the required properties, the only requirement being that where the liquid phase comprises two or more liquid components, they are miscible when in the total composition or one is dispersible in the other, in the form of fine droplets.

Thus, where surfactants are solids, they will usually be dissolved or dispersed in the liquid phase. Where they are liquids, they will usually constitute all or part of the liquid phase. Also, as mentioned earlier above, some surfactants are also eminently suitable as deflocculants.

In general, suitable surfactants may be chosen from any of the classes, sub-classes and specific materials described in 'Surface Active Agents' Vol. I, by Schwartz & Perry, Interscience 1949 and 'Surface Active Agents' Vol. II by Schwartz, Perry & Berch (Interscience 1958), in the current edition of "McCutcheon's Emulsifiers & Detergents" published by the McCutcheon division of Manufacturing Confectioners Company or in 'Tensid-Taschenbuch', H. Stache, 2nd Edn., Carl Hanser Verlag, München & Wien, 1981.

Liquid surfactants are an especially preferred class of material to use in the liquid phase, especially polyalkoxylated types and in particular polyalkoxylated nonionic surfactants.

As a general rule, the applicants have found that the most suitable liquids to choose are those organic liquids having polar molecules. In particular, those comprising a relatively lipophilic part and a relatively hydrophilic part, especially a hydrophilic part rich in electron lone pairs, tend to be well suited. This is completely in accordance with the observation that liquid surfactants, especially polyalkoxylated nonionics, are one preferred.

Nonionic detergent surfactants are well-known in the art. They normally consist of a water-solubilizing polyalkoxylene or a mono- or di-alkanolamide group in chemical combination with an organic hydrophobic group derived, for example, from alkylphenols in which the alkyl group contains from about 6 to about 12 carbon atoms, dialkylphenols in which each alkyl group contains from 6 to 12 carbon atoms, primary, secondary or tertiary aliphatic alcohols (or alkyl-capped derivatives thereof), preferably having from 8 to 20 carbon atoms, monocarboxylic acids having from 10 to about 24 carbon atoms in the alkyl group and polyoxypropylenes. Also common are fatty acid mono- and dialkanolamides in which the alkyl group of the fatty acid radical contains from 10 to about 20 carbon atoms and the alkyloyl group having from 1 to 3 carbon atoms. In any of the mono- and di-alkanolamide derivatives, optionally, there may be a polyoxyalkylene moiety joining the latter groups and the hydrophobic part of the molecule. In all polyalkoxylene containing surfactants, the polyalkoxylene moiety preferably consists of from 2 to 20 groups of ethylene oxide or of ethylene oxide and propylene oxide groups. Amongst the latter class, particularly preferred are those described in European specification EP-A-225654 (Unilever), especially for use as all or part of the solvent. Also preferred are those ethoxylated nonionics which are the condensation products of fatty alcohols with from 9 to 15 carbon atoms condensed with from 3 to 11 moles of ethylene oxide. Examples of these are the condensation products of $C_{11-13}$ alcohols with (say) 3 or 7 moles of ethylene oxide. These may be used as the sole nonionic surfactants or in combination with those of the described in the last-mentioned European specification, especially as all or part of the liquid phase.

Another class of suitable nonionics comprise the alkyl polysaccharides (polyglycosides/oligosaccharides) such as described in any of specifications U.S. Pat. Nos. 3,640,998; 3,346,558; 4,223,129; EP-A-92,355; EP-A-99,183; EP-A-70,074, '75, '76, '77; EP-A-75,994, '95, '96.

Nonionic detergent surfactants normally have molecular weights of from about 300 to about 11,000. Mixtures of different nonionic detergent surfactants may also be used, provided the mixture is liquid at room temperature. Mixtures of nonionic detergent surfactants with other detergent surfactants such as anionic, cationic or ampholytic detergent surfactants and soaps may also be used. If such mixtures are used, the mixture must be liquid at room temperature.

Examples of suitable anionic detergent surfactants are alkali metal, ammonium or alkylolamaine salts of alkylbenzene sulphonates having from 10 to 18 carbon atoms in the alkyl group, alkyl and alkylether sulphates having from 10 to 24 carbon atoms in the alkyl group, the alkylether sulphates having from 1 to 5 ethylene oxide groups, olefin sulphonates prepared by sulphonation of $C_{10}$–$C_{24}$ alpha-olefins and subsequent neutralization and hydrolysis of the sulphonation reaction product.

Other surfactants which may be used include alkali metal soaps of a fatty acid, preferably one containing 12 to 18 carbon atoms. Typical such acids are oleic acid, ricinoleic acid and fatty acids derived from castor oil, rapeseed oil, groundnut oil, coconut oil, palm kernel oil or mixtures thereof. The sodium or potassium soaps of these acids can be used. As well as fulfilling the role of surfactants, soaps can act as detergency builders or fabric conditioners, other examples of which will be described in more detail hereinbelow. It can also be remarked that the oils mentioned in this paragraph may themselves constitute all or part of the liquid phase, whilst the corresponding low molecular weight fatty acids (triglycerides) can be dispersed as solids or function as structurants.

Yet again, it is also possible to utilise cationic, zwitterionic and amphoteric surfactants such as referred to in the general surfactant texts referred to hereinbefore. Examples of cationic detergent surfactants are aliphatic or aromatic alkyl-di(alkyl) ammonium halides and examples of soaps are the alkali metal salts of $C_{12}$-$C_{24}$ fatty acids. Ampholytic detergent surfactants are e.g. the sulphobetaines. Combinations of surfactants from within the same, or from different classes may be employed to advantage for optimising structuring and/or cleaning performance.

Non-surfactants which are suitable liquids include those having the preferred molecular forms referred to above although other kinds may be used, especially if combined with those of the former, more preferred types. In general, the non-surfactant solvents can be used alone or in combination with liquid surfactants. Non-surfactant solvents which have molecular structures which fall into the former, more preferred category include ethers, polyethers, alkylamines and fatty amines, (especially di- and tri-alkyl- and/or fatty- N-substituted amines), alkyl (or fatty) amides and mono- and di- N-alkyl substituted derivatives thereof, alkyl (or fatty) carboxylic acid lower alkyl esters, ketones, aldehydes, and glycerides. Specific examples include respectively, di-alkyl ethers, polyethylene glycols, alkyl ketones (such as acetone) and glyceryl trialkylcarboxylates (such as glyceryl tri-acetate), glycerol, propylene glycol, and sorbitol.

Many light solvents with little or no hydrophilic character are in most systems, unsuitable on their own (i.e. deflocculation will not occur in them). Examples of these are lower alcohols, such as ethanol, or higher alcohols, such as dodecanol, as well as alkanes and olefins. However, they can be combined with other liquids which are surfactants or non-surfactants having the aforementioned 'preferred' kinds of molecular structure. Even though they appear not to play a role in the deflocculation process, it is often desirable to include them for lowering the viscosity of the product and/or assisting soil removal during cleaning.

Preferably, the compositions of the invention contain the liquid phase (whether or not comprising a liquid surfactant) in an amount of at least 10% by weight of the total composition. The amount of the liquid phase present in the composition may be as high as about 90%, but in most cases the practical amount will lie between 20 and 70% and preferably between 20 and 50% by weight of the composition.

Optionally, the compositions of the present invention may also contain one or more other deflocculants selected from those referred to in the published prior art.

The level of the total amount of deflocculant material in the composition can be optimised by the means hereinbefore described but in very many cases is at least 0.01%, usually 0.1% and preferably at least 1% by weight, and may be as high as 15% by weight. For most practical purposes, the amount ranges from 2–12%, preferably from 4–10% by weight, based on the final composition. In many cases, the deflocculant material will consist substantially only of one or more di-sulphonic acids or salts thereof.

The compositions according to the present invention preferably contain one or more other functional ingredients, with the proviso that they must contain at least one ingredient in the form of dispersed solid particles. For example, these may be selected from detergency builders, bleaches or bleach systems, and (for hard surface cleaners) abrasives.

The detergency builders are those materials which counteract the effects of calcium, or other ion, water hardness, either by precipitation or by an ion sequestering effect. They comprise both inorganic and organic builders. They may also be sub-divided into the phosphorus-containing and non-phosphorus types, the latter being preferred when environmental considerations are important.

In general, the inorganic builders comprise the various phosphate-, carbonate-, silicate-, borate- and aliminosilicate-type materals, particularly the alkali-metal salt forms. Mixtures of these may also be used.

Examples of phosphorus-containing inorganic builders, when present, include the water-soluble salts, especially alkali metal pyrophosphates, orthophosphates, polyphosphates and phosphonates. Specific examples of inorganic phosphate builders include sodium and potassium tripolyphosphates, phosphates and hexametaphosphates.

Examples of non-phosphorus-containing inorganic builders, when present, include water-soluble alkali metal carbonates, bicarbonates, borates, silicates, metasilicates, and crystalline and amorphous alumino silicates. Specific examples include sodium carbonate (with or without calcite seeds), potassium carbonate, sodium and potassium bicarbonates, silicates and zeolites.

Examples of organic builders include the alkali metal, ammonium and substituted, citrates, succinates, malonates, fatty acid sulphonates, carboxymethoxy succinates, ammonium polyacetates, carboxylates, polycarboxylates, aminopolycarboxylates, polyacetyl carboxylates and polyhydroxsulphonates. Specific examples include sodium, potassium, lithium, ammonium and substituted ammonium salts of ethylenediaminetetraacetic acid, nitrilotriacetic acid, oxydisuccinic acid, melitic acid, benzene polycarboxylic acids and citric acid. Other examples are organic phosphonate type sequestering agents such as those sold by Monsanto under the tradename of the Dequest range and alkanehydroxy phosphonates.

Other suitable organic builders include the higher molecular weight polymers and co-polymers known to have builder properties, for example appropriate polyacrylic acid, polymaleic acid and polyacrylic/- polymaleic acid co-polymers and their salts, such as those sold by BASF under the Sokalan Trade Mark.

The aluminosilicates are an especially preferred class of non-phosphorus inorganic builders. These for example are crystalline or amorphous materials having the general formula:

$$Na_Z(AlO_2)_Z(SiO_2)_{y\times H2}O$$

wherein Z and Y are integers of at least 6, the molar ratio of Z to Y is in the range from 1.0 to 0.5, and x is an integer from 6 to 189 such that the moisture content is from about 4% to about 20% by weight (termed herein, 'partially hydrated'). This water content provides the best rheological properties in the liquid. Above this level (e.g. from about 19% to about 28% by weight water content), the water level can lead to network formation. Below this level (e.g. from 0 to about 6% by weight water content), trapped gas in pores of the material can be displaced which causes gassing and tends to lead to a viscosity increase also. However, it will be recalled that anhydrous materials (i.e. with 0 to about 6% by weight of water) can be used as structurants. The preferred range of aluminosilicate is from about 12% to about 30% on an anhydrous basis. The aluminosilicate preferably has a particle size of from 0.1 to 100 microns, ideally betweeen 0.1 and 10 microns and a calcium ion exchange capacity of at least 200 mg calcium carbonate/g.

Suitable bleaches include the halogen, particularly chlorine bleaches such as are provided in the form of alkalimetal hypohalites, e.g. hypochlorites. In the application of fabrics washing, the oxygen bleaches are preferred, for example in the form of an inorganic persalt, preferably with an precursor, or as a peroxy acid compound.

In the case of the inorganic persalt bleaches, the precursor makes the bleaching more effective at lower temperatures, i.e. in the range from ambient temperature to about 60° C., so that such bleach systems are commonly known as low-temperature bleach systems and are well known in the art. The inorganic persalt such as sodium perborate, both the monohydrate and the tetrahydrate, acts to release active oxygen in solution, and the precursor is usually an organic compound having one or more reactive acyl residues, which cause the formation of peracids, the latter providing for a more effective bleaching action at lower temperatures than the peroxybleach compound alone. The ratio by weight of the peroxy bleach compound to the precursor is from about 15:1 to about 2:1, preferably from about 10:1 to about 3.5:1. Whilst the amount of the bleach system, i.e. peroxy bleach compound and precursor, may be varied between about 5% and about 35% by weight of the total liquid, it is preferred to use from about 6% to about 30% of the ingredients forming the bleach system. Thus, the preferred level of the peroxy bleach compound in the composition is between about 5.5% and about 27% by weight, while the preferred level of the precursor is between about 0.5% and about 40%, most preferably between about 1% and about 5% by weight.

Typical examples of the suitable peroxybleach compounds are alkalimetal peroborates, both tetrahydrates and monohydrates, alkali metal percarbonates, persilicates and perphosphates, of which sodium perborate is preferred.

Precursors for peroxybleach compounds have been amply described in the literature, including in British patent specifications Nos. 836,988, 855,735, 907,356, 907,358, 907,950, 1,003,310, and 1,246,339, U.S. Pat. Nos. 3,332,882, and 4,128,494, Canadian patent specification No. 844,481 and South African patent specification No. 68/6,344.

The exact mode of action of such precursors is not known, but it is believed that peracids are formed by reaction of the precursors with the inorganic peroxy compound, which peracids then liberate active-oxygen by decomposition.

They are generally compounds which contain N-acyl or O-acyl residues in the molecule and which exert their activating action on the peroxy compounds on contact with these in the washing liquor.

Typical examples of precursors within these groups are polyacylated alkylene diamines, such as N,N,N$^1$,N$^1$-tetraacetylethylene diamine (TAED) and N,N,N$^1$,N$^1$-tetraacetylmethylene diamine (TAMD); acylated glycolurils, such as tetraacetylgylcoluril (TAGU); triacetylcyanurate and sodium sulphophenyl ethyl carbonic acid ester.

A particularly preferred precursor is N,N,N$^1$,N$^1$-tetra- acetylethylene diamine (TAED).

The organic peroxyacid compound bleaches are preferably those which are solid at room temperature and most preferably should have a melting point of at least 50° C. Most commonly, they are the organic peroxyacids and water-soluble salts thereof having the general formula $$HO-O-\overset{\overset{\displaystyle O}{\|}}{C}-R-Y$$

wherein R is an alkylene or substituted alkylene group containing 1 to 20 carbon atoms or an arylene group containing from 6 to 8 carbon atoms, and Y is hydrogen, halogen, alkyl, aryl or any group which provides an anionic moiety in aqueous solution.

Another preferred class of peroxygen compounds which can be incorporated to enhance dispensing/dispersibility in water are the anhydrous perborates described for that purpose in the applicants' European patent specification EP-A-217,454.

When the composition contains abrasives for hard surface cleaning (i.e. is a liquid abrasive cleaner), these will inevitably be incorporated as particulate solids. They may be those of the kind which are water insoluble, for example calcite. Suitable materials of this kind are disclosed in patent specifications EP-A-50,887; EP-A-80,221; EP-A-140,452; EP-A-214,540 and EP No. 9,942 (Unilever), which relate to such abrasives when suspended in aqueous media. Water soluble abrasives may also be used.

The compositions of the invention optionally may also contain one or more minor ingredients such as fabric conditioning agents, enzymes, perfumes (including deoperfumes), micro-biocides, colouring agents, fluorescers, soil-suspending agents (anti-redeposition agents), corrosion inhibitors, enzyme stabilizing agents, and lather depressants.

In general, the solids content of the product may be within a very wide range, for example from 1–90%, usually from 10–80% and preferably from 15–70%, especially 15–50% by weight of the final composition. The alkaline salt should be in particulate form and have an average particle size of less than 300 microns, preferably less than 200 microns, more preferably less than 100 microns, especially less than 10 microns. The particle size may even be of sub-micron size. The proper particle size can be obtained by using materials of the appropriate size or by milling the total product in a suitable milling apparatus.

The compositions are substantially non-aqueous, i.e. they contain little or no free water, preferably no more than 5%, preferably less than 3%, especially less than 1% by weight of the total composition. It has been found by the applicants that the higher the water content, the more likely it is for the viscosity to be too high, or even for setting to occur. However, this may at least in part be overcome by use of higher amounts of, or more effective deflocculants or other dispersants.

Since the objective of a non-aqueous liquid will generally be to enable the formulator to avoid the negative influence of water on the components, e.g. causing incompatibility of functional ingredients, it is clearly necessary to avoid the accidental or deliberate addition of water to the product at any stage in its life. For this reason, special precautions are necessary in manufacturing procedures and pack designs for use by the consumer.

Thus during manufacture, it is preferred that all raw materials should be dry and (in the case of hydratable salts) in a low hydration state, e.g. anhydrous phosphate builder, sodium perborate monohydrate and dry calcite abrasive, where these are employed in the composition. In a preferred process, the dry, substantially anhydrous solids are blended with the liquid phase in a dry vessel. In order to minimise the rate of sedimentation of the solids, this blend is passed through a grinding mill or a combination of mills, e.g. a colloid mill, a corundum disc mill, a horizontal or vertical agitated ball mill, to achieve a particle size of 0.1 to 100 microns, preferably 0.5 to 50 microns, ideally 1 to 10 microns. A preferred combination of such mills is a colloid mill followed by a horizontal ball mill since these can be operated under the conditions required to provide a narrow size distribution in the final product. Of course particulate material already having the desired particle size need not be subjected to this procedure and if desired, can be incorporated during a later stage of processing.

During this milling procedure, the energy input results in a temperature rise in the product and the liberation of air entrapped in or between the particles of the solid ingredients. It is therefore highly desirable to mix any heat sensitive ingredients into the product after the milling stage and a subsequent cooling step. It may also be desirable to de-aerate the product before addition of these (usually minor) ingredients and optionally, at any other stage of the process. Typical ingredients which might be added at this stage are perfumes and enzymes, but might also include highly temperature sensitive bleach components or volatile solvent components which may be desirable in the final composition. However, it is especially preferred that volatile material be introduced after any step of aeration. Suitable equipment for cooling (e.g. heat exchangers) and de-aeration will be known to those skilled in the art.

It follows that all equipment used in this process should be completely dry, special care being taken after any cleaning operations. The same is true for subsequent storage and packing equipment.

The present invention will now be described with reference to the following examples. In these, unless indicated to the contrary, all examples are by weight.

Example A

| | wt % |
|---|---|
| Dry milled sodium tripolyphoshpate | 65.7 |
| Plurafac RA30(1) | 32.3 |
| Dowfax 3B2 Acid(2) | 2.0 |

(1) Nonionic surfactant comprising $C_{9-11}$ fatty alcohol alkoxylated with an average of 4–5 moles of ethylene oxide and 2–3 moles of propylene oxide (ex ICI).
(2) Free di-sulphonic acid deflocculant prepared from the corresponding salt which is Dowfax 3B2 (ex Dow Chemicals), corresponding to formula (I) wherein $R^1$ and $R^2$ are both decyl, $Ph^1$ and $Ph^2$ are unsubstituted except for the sulphonic acid groups and X is oxa (—O—).

Example B

| | Compostions (% by weight) | | |
|---|---|---|---|
| | 1 | 2 | 3 |
| Plurafac RA30 | 36.1 | 38.6 | 41.3 |
| Glyceryl Triacetate | 5.0 | 5.0 | — |
| Dowfax 3B2 Acid | 3.0 | 1.0 | — |
| STP 0.aq | 30.0 | — | — |
| Activated Zeolite | — | 24.5 | 2.8 |
| Sokalan CP5* | — | 5.5 | — |
| Soda Ash | 4.0 | — | 42.2 |
| Calcite | — | — | 6.8 |
| Na Perborate Monohydrate | 13.4 | 13.0 | 6.0 |
| Na Peroxoborate | 2.1 | 2.0 | 0.9 |
| TAED | 4.0 | 4.0 | — |
| minors ** | | balance | |

*acrylic acid/maleic acid co-polymer, average molecular weight 70,000, acrylic acid: maleic acid ratio 1:1.
**enzyme, bleach stabiliser, corrosion inhibitor, anti-redeposition agent, perfume.

Example C

Compositions were prepared containing Plurafac RA30 nonionic surfactant and sodium tripolyphosphate in the weight ratio of 5:4, and a given percentage of a given sulphonic acid. To demonstrate the effectiveness of the sulphonic acid as a deflocculant, the peak and equilibrium viscosities of each composition was measured at 25° C. ad 21 $sec^{-1}$, with the following results:

| Sulphonic acid | % by wt | peak viscosity (Pa) | equilibrium viscosity (Pa) |
|---|---|---|---|
| $C_{12}$ alkyl benzene sulphonic acid | 0.2 | 35.2 | 20.3 |
| | 0.5 | 35.2 | 17.3 |
| | 1.0 | 35.2 | 15.6 |
| | 2.0 | 13.0 | 10.9 |
| | 5.0 | 21.1 | 17.6 |
| di-$C_{10}$ alkyl benzene sulphonic acid | 0.2 | 9.5 | 8.4 |
| | 0.5 | 10.2 | 9.1 |
| | 1.0 | 9.5 | 8.3 |
| | 2.0 | 11.8 | 6.1 |
| di-$C_{12}$ alkyl benzene sulphonic acid | 0.2 | 15.1 | 14.5 |
| | 0.5 | 20.4 | 19.3 |
| | 1.0 | 12.3 | 11.1 |
| | 2.0 | 9.7 | 8.0 |

These results show that for a given level of deflocculant, the disulphonic acids are preferred over the monosulphonic acid, especially with regard to the peak viscosity.

We claim:

1. A non-aqueous cleaning composition comprising from 10% to 90% by weight of a liquid phase selected from liquid surfactants, non-surfactant liquid solvents and mixtures thereof and from 1% to 90% by weight of a particulate solid phase dispersed in said liquid phase, the composition further comprising from 0.1% to 15% by weight of a deflocculant for the solid phase, said deflocculant being selected from the group consisting of:

(a) disulphonic acid compounds of formula (I):

$$R^1—Ph^1—X—Ph^2—R^2 \quad (I)$$

wherein $R^1$ and $R^2$ are independently selected from linear or branched $C_{2-20}$ alkyl or $C_{2-20}$ alkenyl groups, $Ph^1$ and $Ph^2$ are phenylene linkages each substituted by a sulphonic acid group in its free acid form, and each optionally independently substituted by one or more minor substituents, and X is selected from oxa (—O—), thia (—S—), amine (—NH—) and methylene ($—CH_2$) linkages; or partially neutralized mono acid salts wherein one sulphonic acid group is in the free acid form and the second sulfonic acid group is partially neutralized, of said disulphonic acid compounds;

and (b) 20–20 carbon atom linear or branched alkyl and alkenyl benzene-disulphonic acids in their free acid form or partially neutralized mono acid salts thereof.

2. A composition according to claim 1, wherein the deflocculant is selected from di-benzene-sulphonic acids in their free acid form and partially neutralized mono acid salts thereof.

3. A composition according to claim 1, wherein $R^1$ and $R^2$ in formula (I) are both decyl, $Ph^1$ and $Ph^2$ are unsubstituted except for the sulphonic acid groups and X is oxa (—O—).

4. A composition according to claim 1, wherein the liquid phase comprises a polyalkoxylated fatty alcohol nonionic surfactant.

5. A composition according to claim 1, wherein the particulate solid phase is selected from detergency builders and mixtures thereof with other detergent ingredients.

6. A composition according to claim 5, wherein the detergency builder is selected from alkali-metal aluminosilicates, alkali-metal tripolyphosphates and alkali-metal carbonates.

7. A composition according to claim 1, showing less than 1% phase separation after storage for one week at ambient temperature.

8. A method of cleaning a surface comprising contacting the surface, optionally in the presence of water, with a non-aqueous liquid cleaning composition according to claim 1.

* * * * *